United States Patent [19]

Navetta

[11] Patent Number: 4,841,687

[45] Date of Patent: Jun. 27, 1989

[54] MOISTURE DEFLECTOR FLASHING STRIP FOR A BUILDING WALL ASSEMBLY

[76] Inventor: Michael Navetta, 41075 Coventry, Novi, Mich. 48050

[21] Appl. No.: 228,052

[22] Filed: Aug. 4, 1988

[51] Int. Cl.[4] ..... E06B 1/04

[52] U.S. Cl. ..... 52/58; 52/204; 52/303

[58] Field of Search ..... 52/303, 60, 204, 408, 52/409, 58, 59, 61, 62

[56] References Cited

U.S. PATENT DOCUMENTS

| | | | |
|---|---|---|---|
| 2,856,871 | 10/1958 | Orth et al. | 52/60 |
| 3,293,810 | 12/1966 | Cox et al. | 52/303 |
| 3,533,201 | 10/1970 | Tyler | 52/60 |
| 3,942,292 | 3/1976 | Robinson | 52/61 X |
| 4,106,247 | 8/1978 | Svensson | 52/204 |
| 4,282,691 | 8/1981 | Risdon | 52/303 X |

*Primary Examiner*—John E. Murtagh
*Assistant Examiner*—Anthony W. Williams
*Attorney, Agent, or Firm*—Cullen, Sloman, Cantor, Grauer, Scott & Rutherford

[57] ABSTRACT

In a building wall assembly including an outer veneer wall, a series of laterally spaced studs, an upright laterally extending lower wall board spanning the studs and a laterally extending upper wall board spanning and secured to the studs and overlying the lower wall board, with the wall boards spaced from the veneer wall, a unit moisture reflector flashing strip of a resilient material having laterally extending mount, reflector and sealing portions, with the mount portion underlying the lower edge of the upper wall board, bearing against and secured to the studs, with the deflector portion extending angularly downward and outwardly of the lower wall board and with the sealing portion against the lower wall board across its width.

14 Claims, 2 Drawing Sheets

MOISTURE DEFLECTOR FLASHING STRIP FOR A BUILDING WALL ASSEMBLY

FIELD OF THE INVENTION

The present invention is directed to flashing strips excluding water and moisture from the interior of a building and more particularly to a building wall assembly which includes an outer veneer wall, laterally spaced studs upon one side thereof and spaced therefrom one or a plurality of lower wall boards spanning the studs and one or a plurality of upper wall boards spanning and secured to the studs and overlying the lower wall boards. A moisture deflector flashing strip is employed between the upper and lower wall boards for deflecting liquids accumulated within the upper wall boards from the lower wall boards.

BACKGROUND OF THE INVENTION

Previously in building wall assemblies including an outer veneer wall, a series of laterally spaced studs upon one side thereof and spaced from said wall and wherein upper and lower sets of wall boards span the respective studs, there has been the problem of preventing the accumulated moisture upon the upper wall boards from entering into the interior of the lower wall boards and for communication into the space between the studs and any interior room adjacent thereto. Various efforts have been made to prevent such accumulating moisture from passing through the lower wall boards and into a building assembly.

PRIOR ART

Building and roof flashings are shown in one or more of the following United States Patents:

| Pat. No. | Inventor | Date |
|---|---|---|
| 2,250,548 | William H. C. Ness | July 29, 1941 |
| 2,271,710 | Herbert P. Orth | February 3, 1942 |
| 2,974,448 | Morley M. Weis | March 14, 1961 |
| 3,241,272 | Harlan H. Edwards | March 22,1966 |
| 3,942,292 | Brian Robinson, et al | March 9, 1976 |

SUMMARY OF THE INVENTION

An important feature of the present invention is to provide a unit moisture deflector flashing strip of a resilient material which has considerable lateral extent at least coextensive with the width of adjacent upper and lower wall boards applied to a series of building studs and wherein an upper portion of the flashing strip underlies the upper wall boards and is secured to the studs, an intermediate portion of the flashing strip defines a deflection portion which underlies the upper wall boards, overlies the upper edges of the bottom wall boards and includes a depending sealing portion which is biased against the lower wall boards and wherein any liquids or moisture accumulating in the upper wall boards descends and is deflected outwardly of the lower wall boards preventing inward migration thereof to the spaces between the studs and adjacent room areas of a building.

Another important feature is to provide a unit moisture deflector flashing strip of a resilient material which is mounted along and behind the lower edges of the upper row of wall boards and secured to the adjacent studs and wherein an intermediate moisture deflection portion extends angularly outwardly and downwardly to protectively overly the upper edges of the lower wall boards and which terminates in an inwardly directed sealing portion adapted for an inward bias along and against intermediate portions of the bottom wall boards throughout their width to prevent any accumulating moisture from entering into the lower wall boards and for deflection therefrom.

Another feature is to provide in an unit moisture deflector flashing strip plurality of angularly related portions including a mount portion, a deflector portion, and a sealing portion and wherein the sealing mount portion includes a pair of angularly related outwardly converging mount strips defining a laterally elongated apex, and wherein the fasteners for securing the flashing strips to the studs upon the under surface of the upper wall board, when fully assembly into the studs places the mount strips in tension so that the respective top and bottom laterally extending edges of the flashing strip are biased inwardly. The sealing portion of the flashing strip is biased against the lower wall boards in sealing engagement therewith along their width.

As an important feature there are provided a series of laterally extending and laterally overlapped inner moisture deflector flashing strips of a resilient material so there is provided in effect a continuous flashing between an upper series of wall boards and a lower series of wall boards such as will deflect any descending moisture from the upper wall boards outwardly of the lower wall boards. This prevents accumulation of any moisture or water upon the interior of the lower wall boards.

As an important feature a series of laterally spaced spacers are mounted upon the respective studs inwardly of lower edge portions of the upper wall boards outwardly flexing lower edge portions of the upper wall boards outwardly to a position so as to be generally outward of the plane of the lower wall boards.

As another feature the fasteners which anchor the moisture deflector flashing strip to the studs also anchor the corresponding spacers thereagainst and deflect lower edge portions of the upper wall boards from the studs.

As another feature, the present unit moisture deflector flashing strip is constructed of a resilient material and includes for the mount portion a pair of outwardly converging mount strips defining a laterally elongated apex and wherein the fasteners for the flashing strip extend through the apex and when secured to the studs deflect the mount strips into alignment and under tension and wherein the top and bottom edges of the flashing strips are biased inwardly with the sealing portion thereof bearing against the lower wall board along its width and for further biasing the lower wall board against the studs.

These and other features and objects will be seen from the following specification and claims in conjunction with the appended drawings.

THE DRAWING

Figure 1:
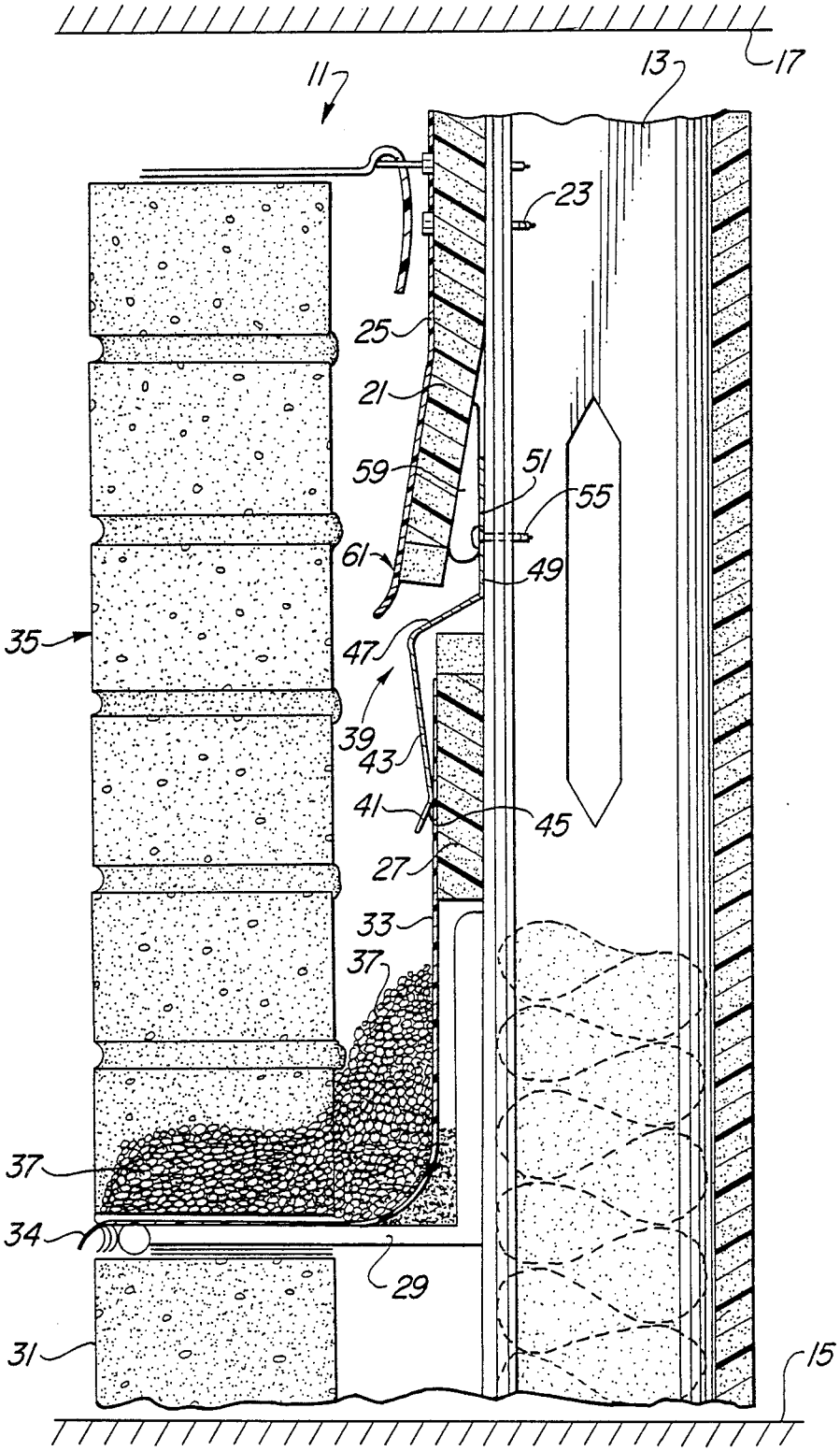
FIG. 1 is a fragmentary section of a building wall assembly with the present moisture deflecting flashing strip located between the upper and lower wall boards thereof.

It will be understood that the above drawings illustrate merely a preferred embodiment of the invention, and that other embodiments are contemplated within the scope of the claims hereafter set forth.

DETAILED DESCRIPTION OF AN EMBODIMENT OF THE INVENTION

Referring to the drawing, the veneer steel stud wall assembly or system indicated at 11, sometimes hereafter referred to as a building wall assembly, includes an outer veneer wall 35, a series of laterally spaced studs 13, preferably steel studs. In the preferred embodiment, the studs are of U-shape, mounted upon a bottom support 15 or footing, and anchored with respect to top support 17.

Upper drywall or wall board or sheeting 21 spans the aligned ends of the corresponding studs 13 and is secured thereto by a plurality of laterally spaced fasteners 23. The fasteners extend through the corresponding wall board 21 adjacent its upper portion and through corresponding portions of the respective studs 13. The fasteners are self-threading fasteners or screws. Applied along the exterior surface of the upper wall board 21 is a waterproof sheeting membrane 25, FIG. 1. Generally underlying the upper wall board 21 is a lower drywall or wall board 27 which bears against the respective studs 13, overlies and rests upon a portion of the laterally extending right angular steel shelf angle 29 upon footing or support 31. Support 31 may include a foundation, structural beams or other supports.

An outer membrane strip or sheeting 33 of L-shape extends along the outer surface of the lower wall board 27 from a point behind the moisture deflector 39 and terminates at its lower end in the outwardly extending end portion 34 which extends through a corresponding opening in the brick wall veneer 35. Said sheeting 33 may be adhered to the lower wall board or loose. It is important that the sealing apex 45 bears against the sheeting 33 to assure its positioning upon the lower wall board 27. A suitable granular fill 37 is interposed between lower portions of the veneer wall 35 and the lower wall board 27 and rests against the corresponding L-shaped moisture resistant membrane sheet 33-34. The granular fill 37 in the illustrative embodiment extend to approxiamtely the top of the first course of the bricks of the veneer wall 35 and through corresponding openings in a portion of the brick wall adjacent shelf angle 29 and along the top surface of the membrane strip 33-34.

Figure 2:
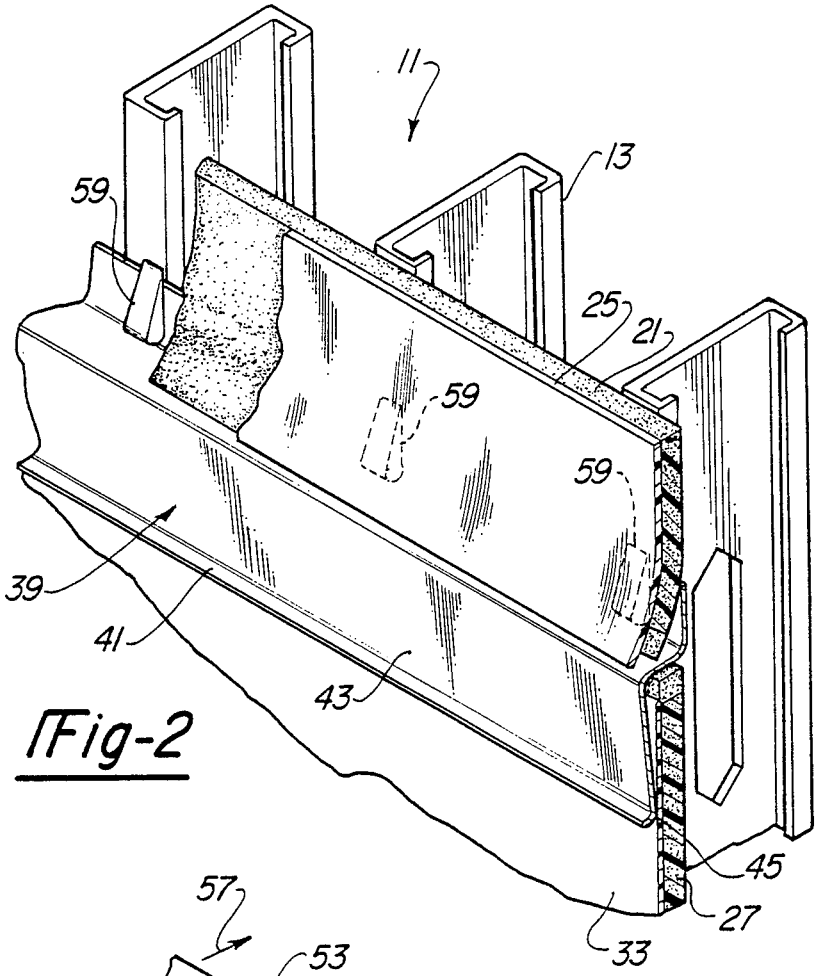
FIG. 2 is a fragmentary perspective view thereof.

The moisture deflector flashing strip 39 of the present invention, FIGS. 1 and 2, is constructed of a resilient material such as steel, plastic or other resilient materials, and is laterally elongated and normally corresponds to the lateral extent of the individual wall boards 21 and 27.

While a single upper and lower wall board is illustrated in FIG. 1 at 21 and 27, it is contemplated that the wall boards may be arranged edge to edge in a laterally extending rows spanning the respective studs 13. The corresponding moisture deflector flashing strips 39 are laterally elongated and at their upright edges overlapped laterally so as to complete a seal between the moisture deflectors, as shown in FIG. 1.

The present moisture deflector flashing strip 39 includes bottom edge strip 41 which is laterally elongated and converges with respect to a laterally elongated deflector sheet 43 defining a laterally elongated sealing apex 45. Said apex is adapted for operating sealing engagement along the width of the lower wall board 27. The respective edge strip 41 and deflector sheet 43 are sometimes referred to hereinafter as a sealing portion of the deflector flashing strip 39, FIG. 2. The present flashing strip 39 includes a laterally elongated deflector face 47 which extends outwardly and converges with respect to the adjacent downwardly and inwardly inclined deflector sheet 43.

The present flashing strip 39 is a unit construction and includes at its upper end first mount strip 49 and adjacent thereto the angularly related second mount strip 51 with the said strips converging outwardly defining a fastening apex 53 which extends laterally the width of the flashing strip 39. In the mounting of the flashing strip 39 upon and spanning the respective studs 13 there are employed a plurality of fasteners such as the sheet metal fasteners 55 which may be self-threading fasteners which are laterally spaced and which extend through the apex edge 53 of the mount portion for the flashing strip 39. Said mount portion includes the first and second mount strips 49 and 51 which are arranged with respect to each other and converge at an obtuse angle.

When the present flashing strip 39 is mounted so as to span a plurality of the studs 13 for securing thereto and when the respective fasteners 55 are tight against the respective flashing strip 39 and studs 13, the respective mount portions or first and second mount strips 49 and 51 are now in alignment placing a tension in the present deflector flashing strip 39, FIGS. 1 and 2.

The result of this tension is that the corresponding top and bottom edges of the flashing strip are biased inwardly at its upper end against the respective studs 13 and along its lower edge against the outer surface of the respective lower wall board 27 throughout its width.

Figure 3:
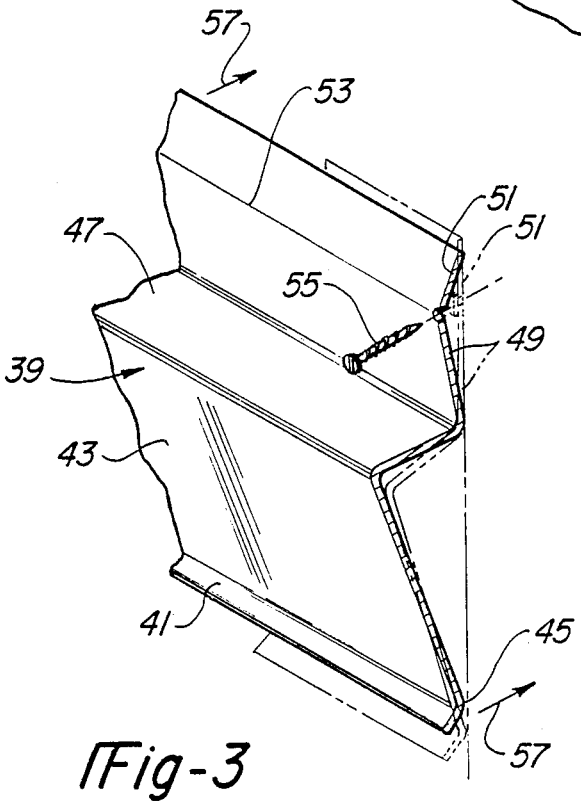
FIG. 3 is a fragmentary perspective view of the moisture deflector flashing strip shown in FIG. 2.
Figure 4:
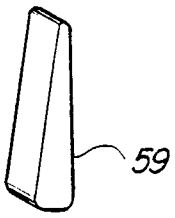
FIG. 4 is a fragmentary perspective view of the spacer shown in FIGS. 1 and 2.

It is the securing of the fasteners 55 as they extend through the apex 53 between the respective strips 49 and 51 which place the flashing strip 39 under tension for effecting the foregoing bias and particularly the bias of the sealing edge or apex 45 along the width of the lower wall board 27, FIG. 1. The bias forces achieved by the use of the fasteners 55 are designated by the arrows 57 adjacent the top and bottom of the flashing strip shown in FIG. 3.

In the assembly of the present moisture deflector flashing strip 39 adjacent and under lower edge portions of the upper wall board 21, there is interposed between the moisture deflector 39 and the wall board a plurality of spacers 59 of a moisture-resistant material, such as Neoprene TM rubber, plastic or metal. These are positioned at the studs, such as shown in FIG. 1, and secured to the studs by the corresponding fasteners 55, being the same fasteners which anchor the flashing strip 39 to the studs. The spacers 59 are tapered downwardly and outwardly for gently bending the drywall outwardly.

The effect of the use of the corresponding spacers 59 is that the lower edge portions of the upper wall board 21 are deflected outwardly as at 61 so as to extend outwardly of the upper edges of the lower wall board 27.

By this construction any moisture or condensation accumulating upon the upper wall board 21 will move downwardly against the inclined surface 47 of the flashing strip 39 and will pass along the outer surface of the deflector sheet 43 and the edge strip 41. Since the edge strip 41 extends angularly outward, any such moisture is deflected laterally outward of the lower wall board 27 and membrane sheet 33. In the illustrative embodiment the outer wall is of a brick veneer as at 35, but may be constructed of other material. It is essential however, that the corresponding upper and lower wall boards 21 and 27 be spaced rearwardly of the outer wall 35.

The membrane sheets 25 and 33 are further constructed of a moisture resistant or moisture proof material such as Neoprene TM, rubber, plastic, metals or other moisture-resistant materials.

The mount portion of the present flashing strip 39 includes pair of outwardly converging mount strips 49 and 51 which define the laterally elongated apex 53. The fasteners 55 extend through said apex and are secured to the studs 13.

The sealing portion of the deflector flashing strip 39 further includes the inwardly inclined deflector sheet 43 and the outwardly extending deflector strip 41 which defines a sealing apex 45 which bears against the lower wall board 27 along its width and performs a further function of biasing the wall board against the corresponding studs 13. The present flashing is adapted to receive and drain water and moisture to provide a moisture barrier to protect the steel from corrosion, develop slide planes for differential movement and to provide bearers against water migration into the wall system. Eventually, when moisture and liquids have accumulated upon the upper wall boards 21, the present flashing strip functions to prevent the downwardly flowing water from going into the lower underlying wall board which instead deflects such moisture outwardly thereof providing a path for the moisture so it does not enter the stud space or wet the interior walls.

Wherever the term "drywall" is used, it is intended to include all various forms of exterior sheeting.

Having described my invention, reference should now be had to the following claims.

I claim:

1. In a building wall assembly including an outer veneer wall, a series of laterally spaced studs, and at least one upright laterally extending lower wall board spanning said studs and at last one upright laterally extending upper wall board spanning and secured to said studs and generally overlying said lower wall board;

said wall boards being spaced from said veneer wall;

a unit moisture deflector flashing strip of resilient material spanning said studs having laterally extending mount, deflection and sealing portions, said mount portion underlying the lower edge of said upper wall board along its width, bearing against and secured to said studs;

said deflection portion extending angularly downward and outwardly of said mount portion overlying the top edge of said bottom wall board along its width; and said sealing portion extending angularly downward and inwardly of said deflection portion and bearing against said bottom wall board along its width, and wherein any liquids or moisture accumulating upon the upper wall board descends and is deflected outwardly of said lower wall board, preventing inward migration thereof to the space between said studs.

2. In the building wall assembly of claim 1, said outer wall being of brick veneer.

3. In the building wall assembly of claim 1, there being a first series of coplanar lower wall boards and a second series of coplanar upper wall boards, and a corresponding series of laterally extending and laterally overlapped moisture deflector flashing strips, with a single deflector strip extending between adjacent upper and lower wall boards.

4. In the building wall assembly of claim 1, there being a plurality of laterally spaced spacers of a moisture-proof material interposed between the flashing strip and said upper wall board and secured to said studs underlying lower edge portions of said upper wall board and deflecting its lower edge outwardly towards said veneer wall, thereby positioning its lower edge outwardly of said lower wall board.

5. In the building wall assembly of claim 4, said spacers being of a material spaced from the group consisting of Neoprene TM, rubber, plastic and metal.

6. In the building wall assembly of claim 4, said securing of said mount portion to said studs including a series of laterally spaced fasteners extending through said mount portion and into said studs, said fasteners further securing said spacers to said studs.

7. In the building wall assembly of claim 1, said securing of said mount portion to said studs including a series of laterally spaced fasteners extending through said mount portion and into said studs.

8. In the building wall assembly of claim 7, further comprising said mount portion of said flashing strip including a pair of outwardly converging mount strips defining a laterally elongated apex, said fasteners extending through said apex, and when secured to said studs, deflecting said mount strips into alignment and under tension and wherein the top and bottom edges of said flashing are biased inwardly with said sealing portion biased against said lower wall board along its width and further biasing said lower wall board against said studs.

9. In the building wall assembly of claim 7, further comprising said sealing portion of the flashing strip including an inwardly converging deflector sheet and edge strip defining a laterally elongated sealing apex biased inwardly against said lower wall board.

10. In the building wall assembly of claim 1, further comprising said sealing portion of the flashing strip including an inwardly converging deflector sheet and edge strip defining a laterally elongated sealing apex biased inwardly against said lower wall board.

11. In the building wall assembly of claim 10, further comprising said edge strip of said sealing portion being inclined away from said lower wall board deflecting descending liquids therefrom.

12. In the building wall assembly of claim 1, said veneer wall having openings there through and further comprising a laterally extending water-resistant membrane sheet overlying the outer surface of said lower wall board and at its lower end out-turned and extending through said corresponding openings in said veneer wall for transmitting any accumulate fluids outwardly of said outer wall.

13. In the building wall assembly of claim 12, said sealing portion bearing against said membrane sheet and retaining and supporting said membrane sheet against said lower wall board.

14. In the building wall assembly of claim 13, further comprising a granular fill interposed between the lower ends of said bottom wall board and outer veneer wall and within openings in said veneer wall, and overlying the membrane sheet upon the outer surface of said lower wall board and that portion thereof which extends through the veneer wall.

* * * * *